US006568139B2

(12) United States Patent
Bot

(10) Patent No.: US 6,568,139 B2
(45) Date of Patent: May 27, 2003

(54) BRIDGE STRUCTURE WITH CONCRETE DECK HAVING PRECAST SLAB

(75) Inventor: Steven R Bot, Oakville (CA)

(73) Assignee: Bot Construction Limited, Oakville (CA)

( * ) Notice: Subject to any disclaimer, the term of this patent is extended or adjusted under 35 U.S.C. 154(b) by 0 days.

(21) Appl. No.: 09/838,242

(22) Filed: Apr. 20, 2001

(65) Prior Publication Data

US 2001/0039773 A1 Nov. 15, 2001

(51) Int. Cl.[7] ..... E04B 1/00

(52) U.S. Cl. ..... 52/250; 52/125.5; 52/332; 52/333; 52/250

(58) Field of Search ..... 52/87, 335, 332, 52/333, 125.5, 250

(56) References Cited

U.S. PATENT DOCUMENTS 1,303,741 A * 5/1919 Thomas ..... 14/2
4,151,025 A 4/1979 Jacobs
4,233,356 A * 11/1980 Jacobs ..... 14/73
4,604,841 A * 8/1986 Barnoff et al. ..... 14/73
5,025,522 A * 6/1991 Eskew et al. ..... 14/6
5,218,795 A * 6/1993 Horstketter ..... 52/125.5
6,115,979 A * 9/2000 Horstketter et al. ..... 52/251

FOREIGN PATENT DOCUMENTS

GB 1 370 043 5/1972

* cited by examiner

*Primary Examiner*—Carl D. Friedman
*Assistant Examiner*—Basil Katcheves
(74) *Attorney, Agent, or Firm*—Ingrid E. Schmidt

(57) ABSTRACT

A precast concrete slab for forming a deck in a bridge superstructure has a chamfer on forward and trailing edges so that adjacent slabs can mate. The slab is reinforced with bars which protrude laterally from the slab on opposite sides and which, in use, extend over support beams. Selected bars are formed in a castellated shape of which inverted U-shaped portions extend above the surface of the precast concrete slab. Conveniently, the U-shaped portions anchor a concrete topping which is poured over the slabs at a bridge site and also provide locations for hooking a crane used to transport the slab at a site.

14 Claims, 10 Drawing Sheets

22b
44
22a
60
22
22
22
22
60
44
3

44
2

44
1

BRIDGE STRUCTURE WITH CONCRETE DECK HAVING PRECAST SLAB

FIELD OF THE INVENTION

This invention relates to a bridge superstructure, and more particularly relates to the construction of a concrete deck made of precast concrete slabs and which rest on a series of precast concrete beams or steel girders.

BACKGROUND OF THE INVENTION

Typically, the construction of bridges is a time consuming task where precast concrete support beams or steel girders are erected on location and customized form work is created between the beams in order to support concrete to be poured onto the form work. To some extent, the form work which is made from wood beams and plywood may be prefabricated but all the components must be trimmed to their final dimensions and assembled on location. After the poured concrete deck has set, the form work is removed. In order to minimize the danger of materials falling from scaffolding onto an underlying roadway and to minimize disruptions to traffic flow, such form work is typically erected and dismantled at night when the roadway is less busy and the roadway may be closed to general circulation.

A system for building a concrete deck with precast concrete slabs is described in U.S. Pat. No. 4,604,841. The slabs are reinforced with prestressed reinforcement rods which must extend throughout the width of the deck across support beams and through adjacent slabs. Because the precast slabs and prestressed rod system is unwieldy, the invention described in U.S. Pat. No. 4,604,841 proposes a precast slab having a width which corresponds to the width of the bridge and which has prestressed reinforcement rods extending throughout the width of the precast slab. The sheer size of such a slab is in itself a deterrent to its use since it is very heavy and difficult to manipulate.

Another problem which is encountered with decks constructed with precast slabs occurs at the joint between slabs placed end to end along the length of the bridge. Because of imperfections inherent in pouring concrete, and the likelihood of slabs becoming damaged during transportation, particularly at the bottom edges of slabs having large dimensions, the forward and trailing edges often do not mate. As a result, some form of sealant must be applied to the joints between slabs before pouring a concrete topping to build the deck to the required thickness.

An object of this invention is to simplify the construction of a bridge superstructure in order to minimize the time required for creating a concrete deck and to minimize the safety hazards to both the patrons using the roadway and the personnel who erect such structures, usually at night, when visibility is poor.

SUMMARY OF THE INVENTION

In accordance with this invention, there is provided a precast concrete slab which is dimensioned to locate between beams and which is reinforced with steel rods at predetermined spaced locations, a selected number of said reinforcement bars extending upwardly above the surface of the precast concrete slab to define anchors for securing a concrete topping to be poured onto the precast concrete slab.

The reinforcement bars comprising said anchors are preferably bent into a castellated shape of which inverted U-shaped portions extend above the surface of the precast concrete slab.

Preferably, the slabs are shaped to abut on each other end to end and have chamfered bottom edges to ensure mating of the upper edges on slabs disposed adjacent to one another.

In accordance with another aspect of the invention, a bridge is constructed by first erecting support beams at predetermined spaced locations and by placing screed adjusters comprising high density expanded polystyrene foam strips along opposed lateral edges of the support beams, locating precast slabs made according to the invention on said screed adjusters to bridge the spaces defined between the beams and form a deck, and pouring a fresh concrete topping over said deck to build the deck to a final pre-determined thickness in accordance with prevailing design considerations. Preferably, the precast slabs are coupled to anchors in the support beams with deck reinforcement bars and ties securing the deck reinforcement bars to the beam anchors and to the slab reinforcement bars.

BRIEF DESCRIPTION OF DRAWINGS

In order that the invention be more clearly understood, a preferred embodiment thereof is described below with reference to the accompanying drawings, in which.

DESCRIPTION OF PREFERRED EMBODIMENT WITH REFERENCE TO DRAWINGS

Figure 1:
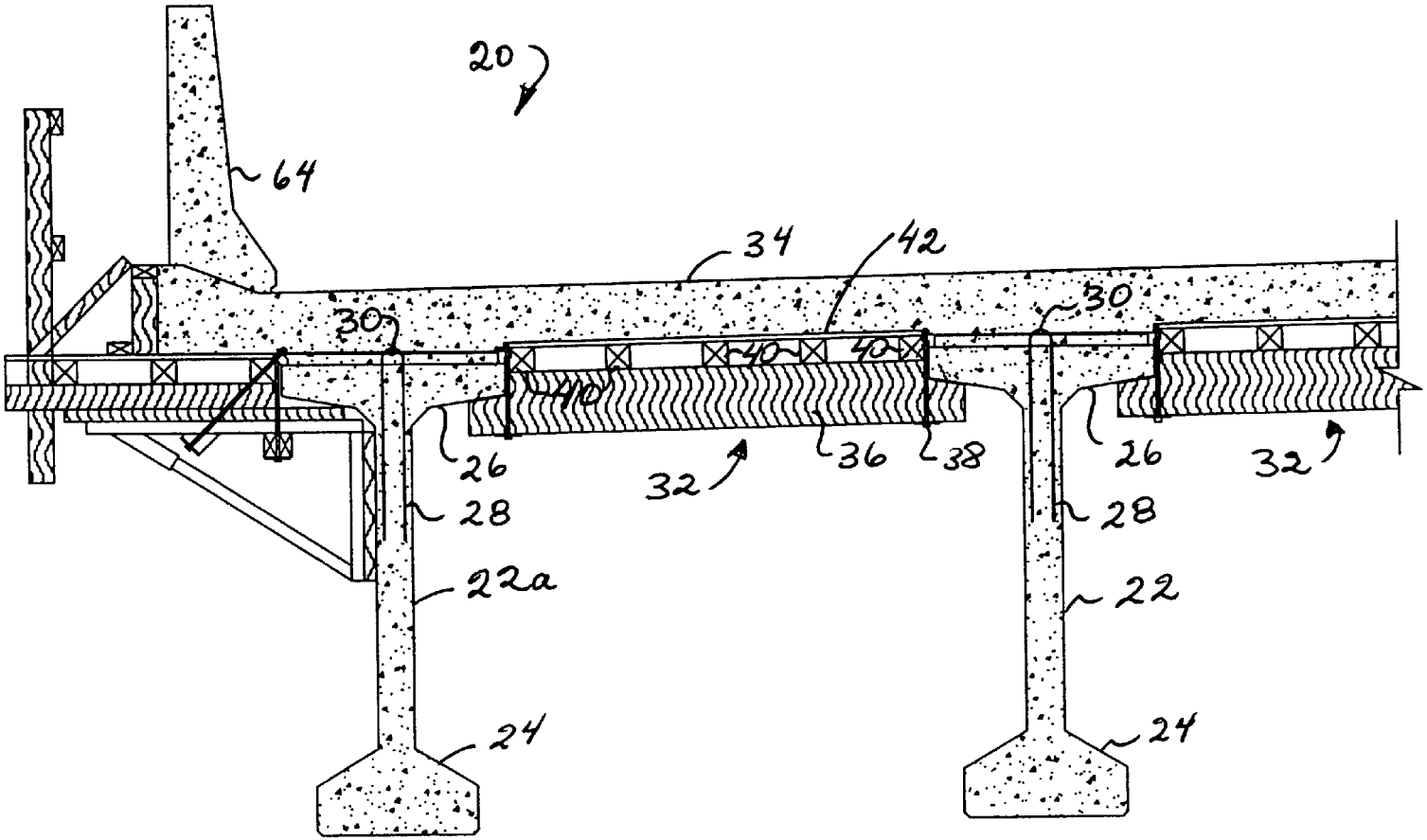
Fig 1 (Prior Art)
FIG. 1 is a schematic side elevation view of a prior art bridge construction including lumber framework.

A typical bridge construction made in accordance with the prior art is illustrated in FIG. 1 in which the bridge superstructure is generally indicated by reference numeral 20. The bridge superstructure 20 comprises a series of support beams 22 which, in this case, are made of precast concrete and which generally have an I-shaped cross-section defining a wide support base 24 and a wide deck platform 26. The support beams 22 are reinforced with reinforcement bars 28 disposed at spaced intervals along the length of the beams 22 and bent into an inverted U-shape with a loop 30 extending above the surface of the deck platform 26 and defining a beam anchor.

Typically form work 32 made in accordance with the prior art spans the separation between the beams 22 and is constructed from lumber in order to provide a platform onto which concrete is poured to form a deck 34. The form work 32 comprises 2×12 doubled bearers 36 supported at each end by steel hangers 38 spaced at approximately three foot intervals on support beams 22. The 2×12 bearers 36 in turn support a plurality of 4×4 beams 40 lying transversely to the 2×12 bearers 36 and spaced a maximum of 400 millimetres apart. The form work 32 is completed by a plywood sheet 42, 17 millimetres in thickness.

All of this form work 32 is trimmed and assembled on location. Once the concrete to form the deck 34 has been poured onto the form work 36 and over the beams 22, and it has set, the form work 32 is removed. The deck is normally completed by laying waterproof sheeting over the concrete, and asphalt (not shown).

Figure 2:
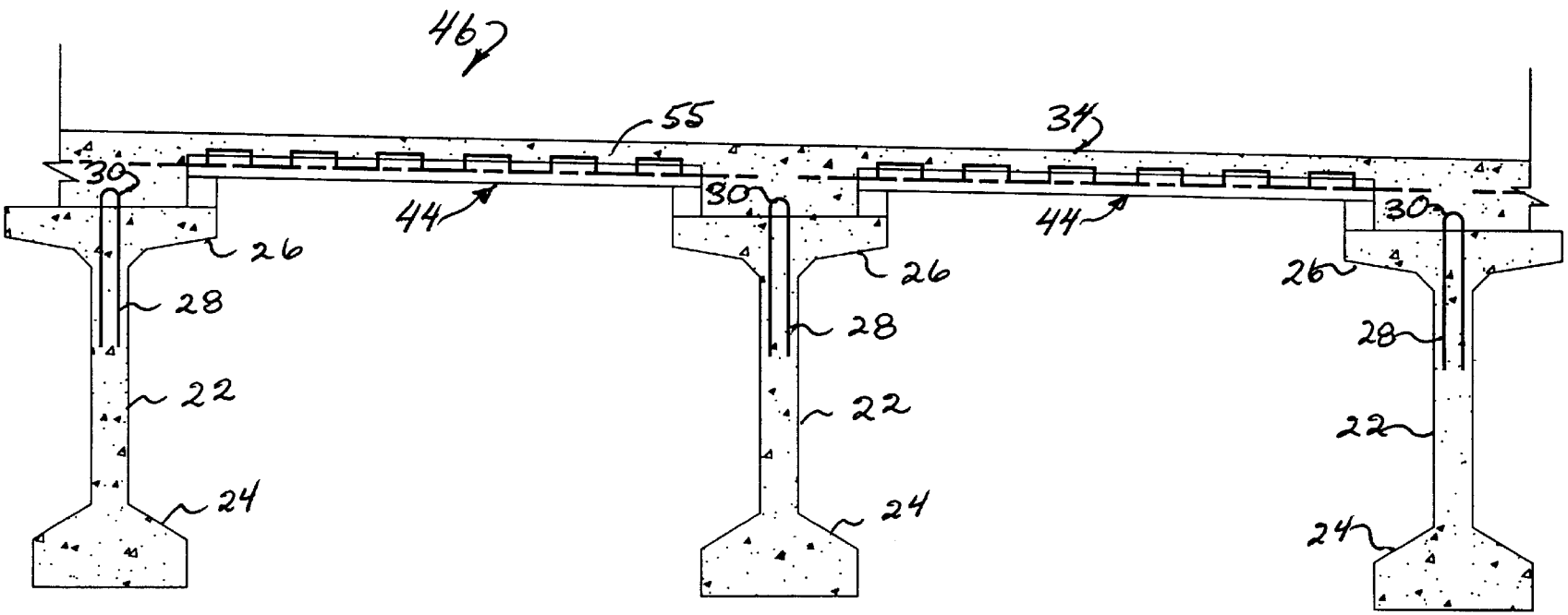
FIG. 2 is a schematic side elevation view of a bridge construction made using a precast concrete slab in accordance with the invention.

In accordance with the invention, the form work 32 is replaced by a precast concrete slab generally indicated by numeral 44 in FIG. 2 of the accompanying drawings. Other features of the resulting bridge superstructure 46 which are similar to the prior art bridge superstructure 20 of FIG. 1 are identified by like numerals.

Figure 3:
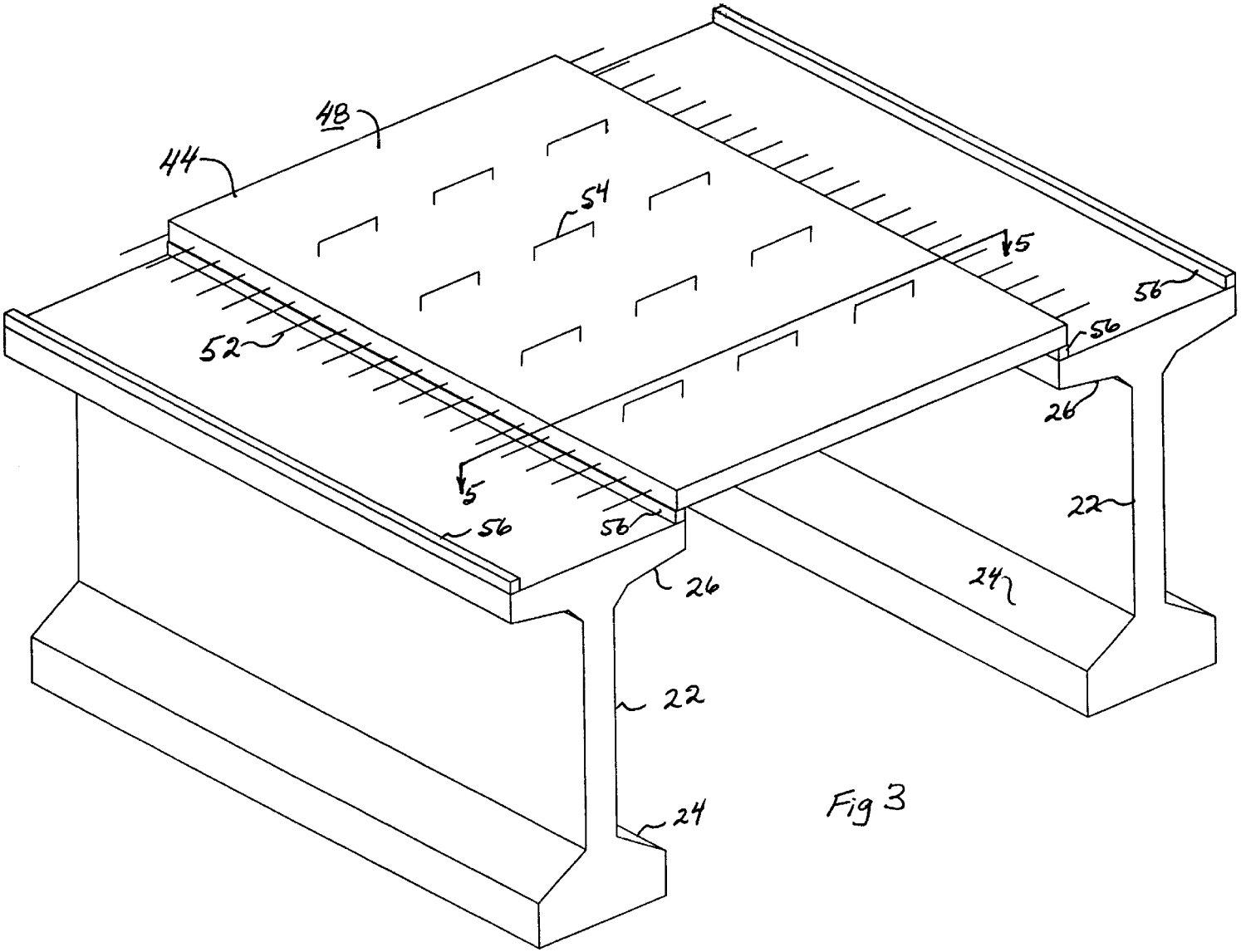
FIG. 3 is a perspective view of a precast concrete slab in accordance with the invention spanning a pair of beams to form a deck.
Figure 4:
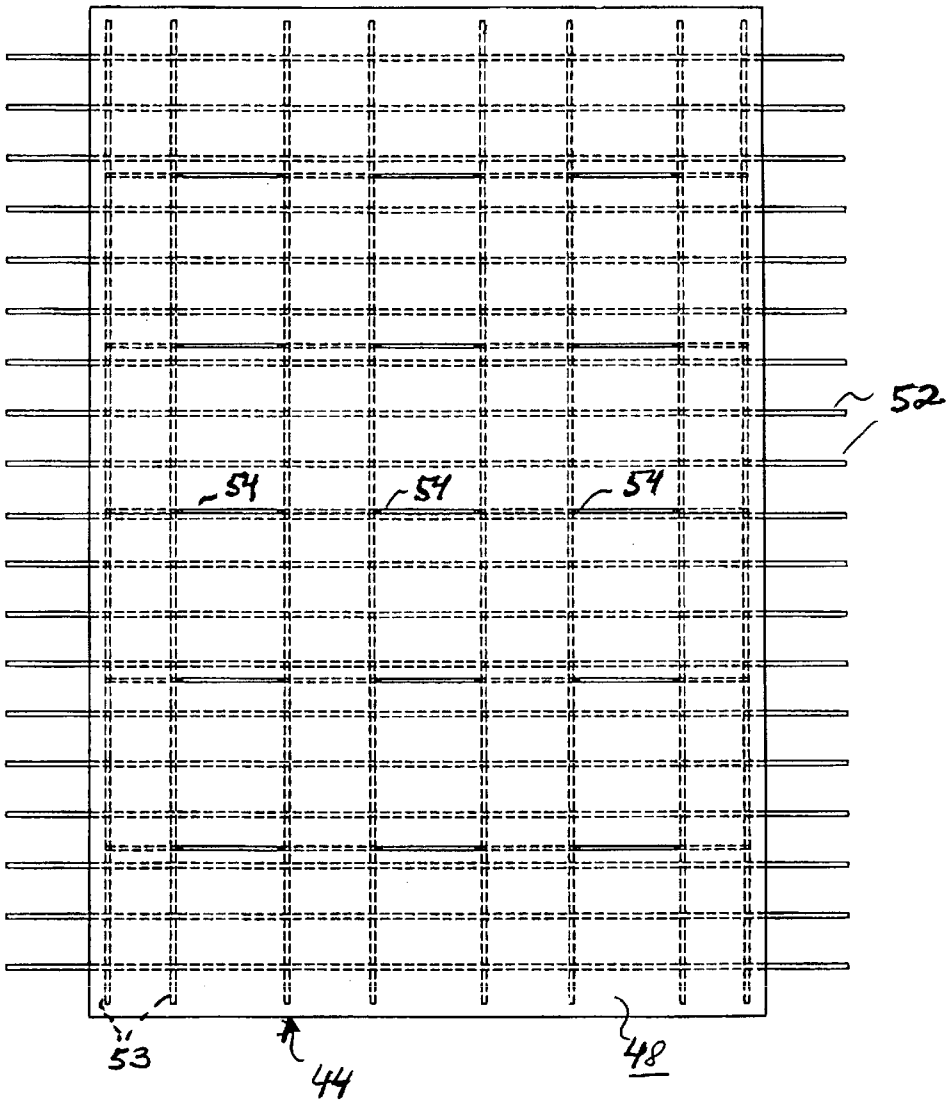
FIG. 4 is a plan view of the precast concrete slab of FIG. 3.

A detailed drawing of the precast slab 44 is shown in FIG. 3 and essentially comprises a rectangular slab which typically will have a length of about 3 metres and a width of 2050 millimetres with a thickness of 90 millimetres. As will be seen more clearly in FIGS. 14 to 17 the top face 48 of the slab is orthogonal to its sides whereas the bottom face 49 is somewhat recessed to define a 20 millimetre chamfer 50 (shown in more detail in FIG. 7 on forward and trailing edges for the slab). A plurality of slab reinforcement bars 52, 53 extend throughout the width and length respectively of the slab 44 in a grid pattern shown in ghost outline in FIG. 4 of the accompanying drawings. The reinforcement bars 52 which extend across the width of the slab 44 have extremities which protrude laterally from both sides of the slab over the deck platform 26 of the associated support beams 22. Since the slab reinforcement bars 52 are not pre-stressed, they may be trimmed and cut, as necessary, for the slabs 44 to follow the contour of an underlying roadway (see FIG. 9).

Figure 5:
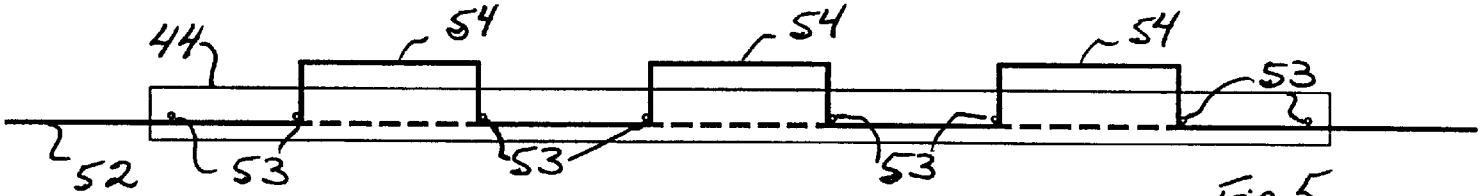
FIG. 5 is a cross-sectional view on line 5—5 of the slab of FIG. 3.

A number of the slab reinforcement bars 52 extend upwardly above the top face 48 of the precast concrete slab 44 to define slab anchors 54 for securing a concrete topping 55 (FIG. 8) to be poured onto the precast concrete slabs 44 and form the deck 34. The reinforcement bars 52 comprising the slab anchors 54 are preferably bent into a castellated shape of which inverted U-shaped portions extend above the top face 48 of the precast concrete slab 44, as will be seen in FIGS. 4 to 6, where the ghost outline shows portions of the slab reinforcement bars 52 which are imbedded in the precast slab and the solid lines show slab reinforcement bars which are exposed until the concrete topping 55 is poured.

Figure 6:
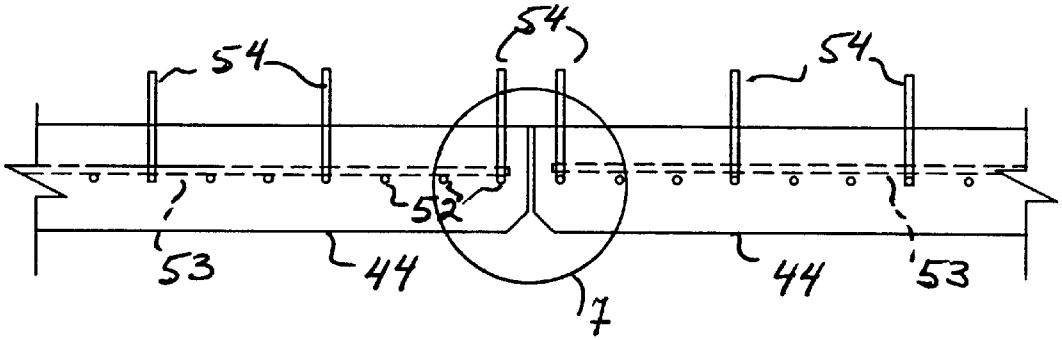
FIG. 6 is a side elevation view of a pair of precast concrete slabs disposed end to end.
Figure 7:
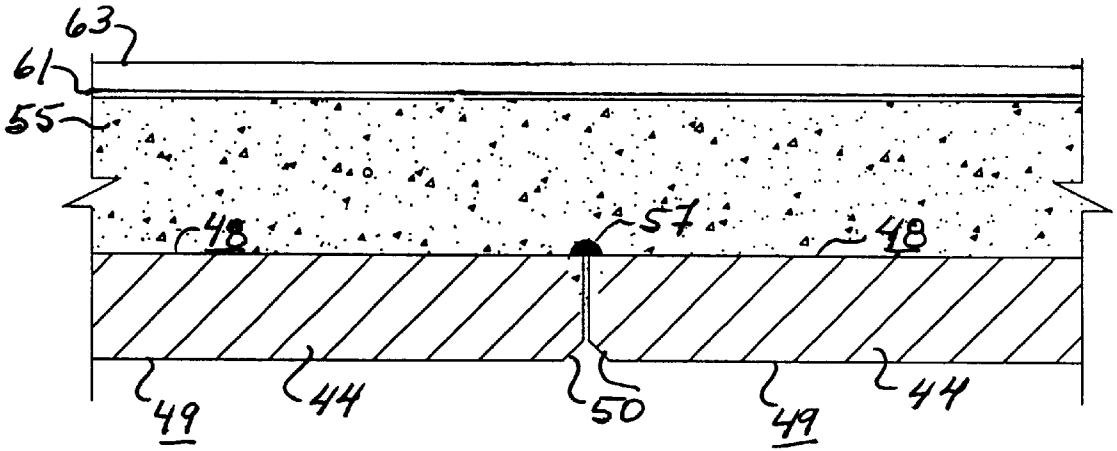
FIG. 7 is a detailed view of circled area 7 of FIG. 6 with a concrete topping, waterproof sheeting and asphalt applied to the surface of the concrete slabs;.
Figures 9, 10, 11, 12:
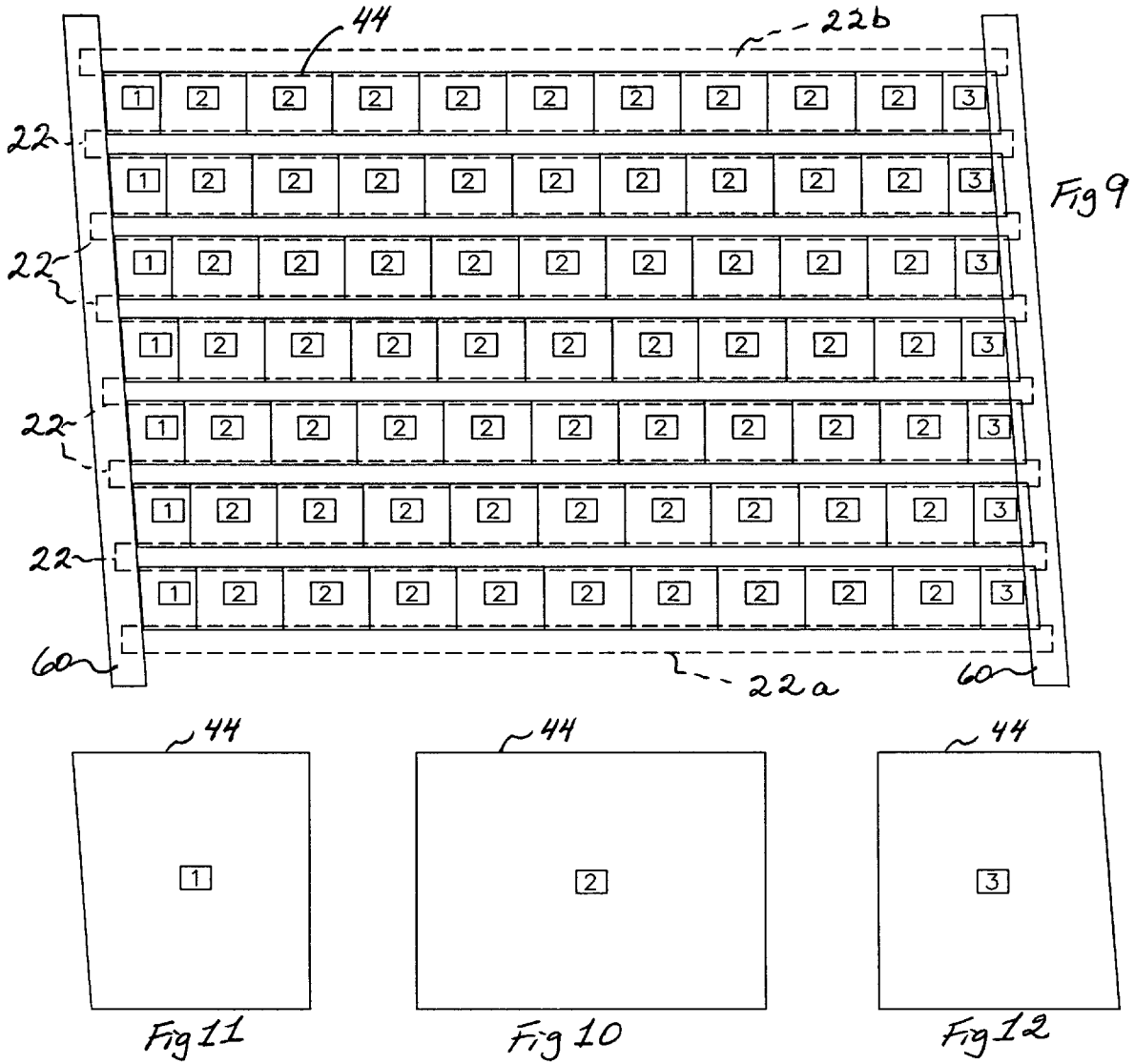
FIG. 9 is a top plan view of a single span for a bridge superstructure showing a precast slab layout.
FIG. 10 is a top plan view of a deck slab of FIG. 9 and drawn to a larger scale.
FIG. 11 is a top plan view of a deck slab of FIG. 9 and drawn to a larger scale.
FIG. 12 is a top plan view of a deck slab of FIG. 9 and drawn to a larger scale.

The precast concrete slabs 44 are placed end to end adjacent one another to extend along the length of the bridge as shown in FIGS. 6 and 9. Where the forward and trailing ends of adjacent slabs 44 meet, the upper edges mate as shown in FIG. 7 and operate to provide a flush surface upon which concrete may be poured without having to use sealants 57 or fillers between adjacent slabs other than in exceptional circumstances in selected locations. When viewed from the bottom, the chamfers 50 of abutting adjacent slabs 44 give the deck 34 a grooved appearance and architectural appeal.

Figure 8:
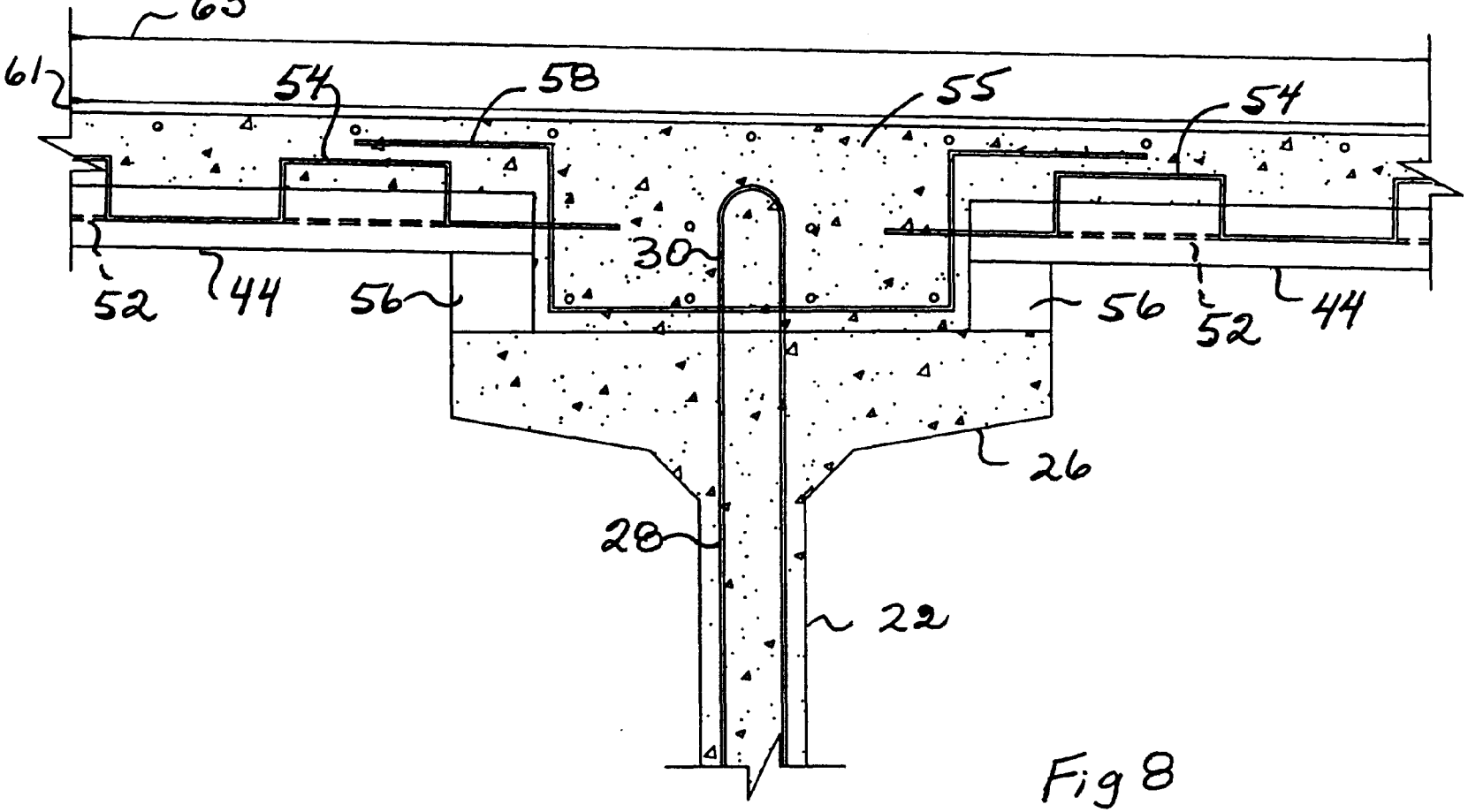
FIG. 8 is a front elevation view of the deck of FIG. 3 with a concrete topping, waterproof sheeting and asphalt applied to the surface of the concrete slabs.

The construction of a bridge superstructure 46 is schematically shown in FIG. 8 and comprises erection of the support beams 22 at predetermined spaced locations and placing screed adjusters 56 comprising high density expanded polystyrene foam strips along opposed edges of the support beam deck platform 26. The polystyrene foam bedding material is typically 50 millimetres wide and will have a height of 40 millimetres to 125 millimetres to suit the screed elevations. The precast concrete slab 44 is lowered by crane over the support beams 22 so as to rest on the screed adjusters 56. Conveniently, the slabs 44 may be transported to a bridge site by hooking into the slab anchors 54. Once the precast concrete slabs 44 are installed, which can be done very quickly and with a minimum of preparation, wet concrete may be poured to form a concrete topping 55. It will be appreciated that the slab anchors 54 serve to mechanically lock the freshly poured concrete of the concrete topping 55 to the precast concrete slabs 44.

The concrete topping 55 extends to a greater depth over the support beams 22 where it is locked by the laterally extending slab reinforcement bars 52 and by the beam anchors or loops 30. Deck reinforcement bars (not shown) are placed over the precast slabs 44 before pouring the concrete topping 55 and will be supported by a number of base structures commonly called a chair and which are placed on the precast slabs 44. Special deck reinforcement bars 58 are used to couple the precast concrete slabs 44 to the beam anchors 30 and comprise lengths of rod having ends which extend horizontally on opposite sides of a support beam 22 over the associated precast slabs 44 and a central portion which reaches the deck platform 26 of the associated support beam 22. Such deck reinforcement bars 58 are placed to cross the laterally extending slab reinforcement bars 52 and beam anchors 30. Ties (not shown) are provided to secure the deck reinforcement bars 58 to the beam anchors 30 and slab reinforcement bars 52. In this way, the invention obviates the need for prestressing the reinforcement provided in the precast slabs.

The slab layout for a typical bridge span is shown in FIG. 9 where the support beams 22 are shown in chain dotted lines and comprise eight in number and spanning a pair of oppositely disposed abutments 60 extending across the width of the bridge. It will be understood that a bridge may comprise a single span as illustrated or a number of spans disposed end to end and supported on a corresponding number of piers in the associated bridge substructure. Typically, a single span, as illustrated, is sufficiently long to bridge two lanes of highway traffic running transversely below the bridge.

The precast slabs 44 are shown in solid lines disposed end to end with forward and trailing edges abutting one another along the length of the associated support beams 22. The deck slabs 44 identified by the numeral 2 have rectangular upper and lower faces, as shown in FIG. 10 and occupy most of the area of the span. Custom formed deck slabs 44 identified by the numerals 1 and 3 and shown in FIGS. 11, and 12 are disposed at the ends of the span and have respective forward and trailing edges which are not orthogonal to their lateral edges. This layout would be typical in bridges where the abutments 60 are not orthogonal to the support beams 22 as a result of changes in the terrain or topography in the area where the bridge is being erected. The deck slabs identified by numerals 1 and 3 could also be cut to the required shape on location, the reinforcement bars not being prestressed.

The deck 34 is completed by laying waterproof sheeting 61 over the concrete topping 55, and asphalt 63 (FIGS. 7 and 8).

Figure 13:
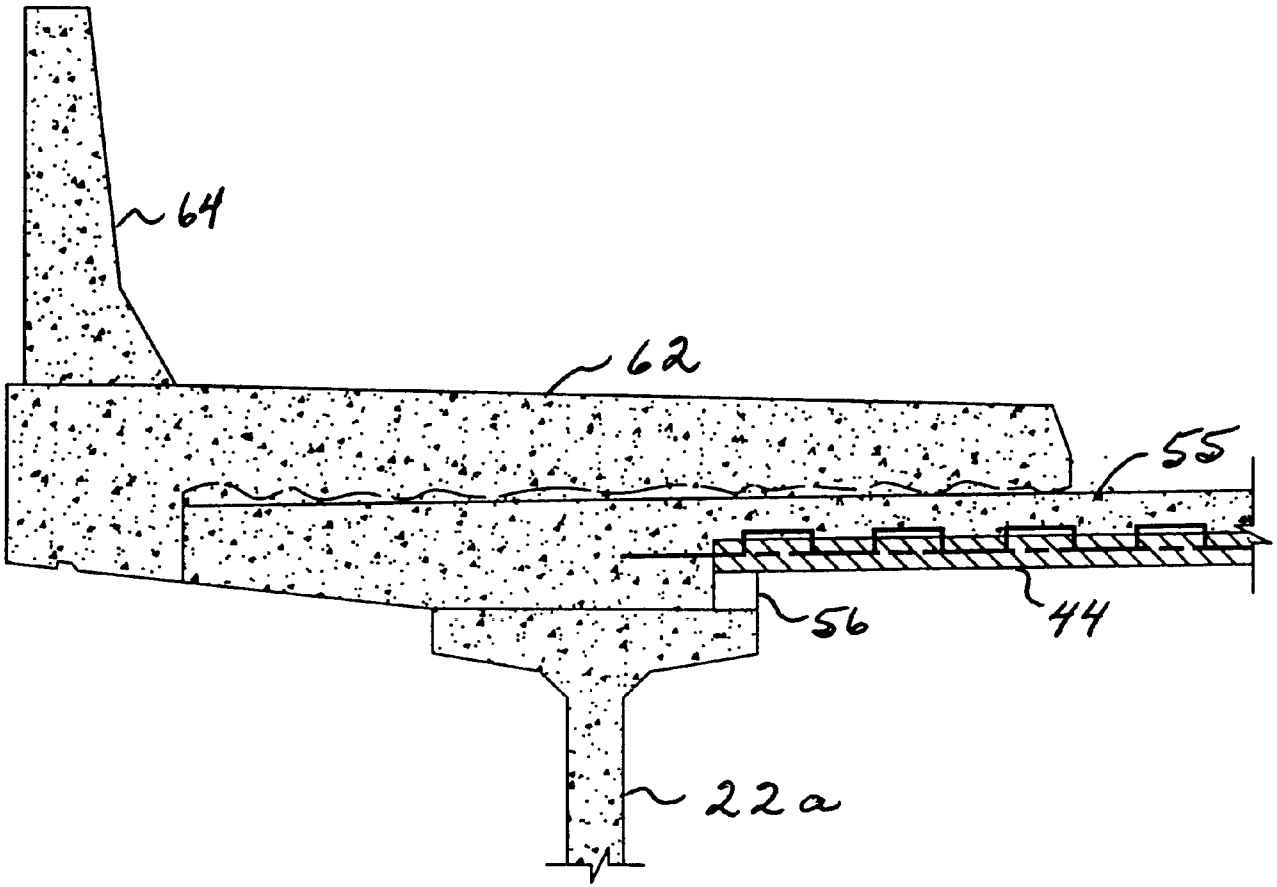
FIG. 13 is an end elevation view of a bridge superstructure showing a sidewalk.
Figure 14:
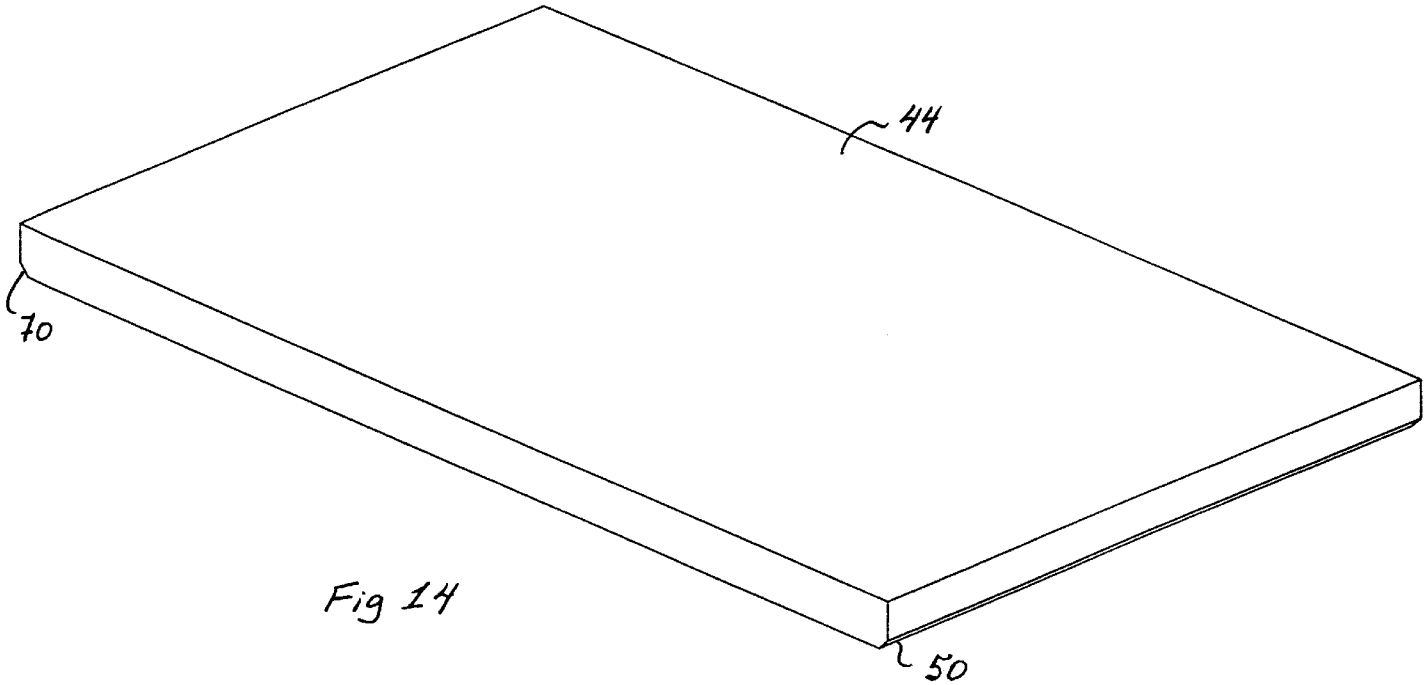
FIG. 14 is an isometric view showing the shape of a precast concrete slab in accordance with the invention.
Figure 15:
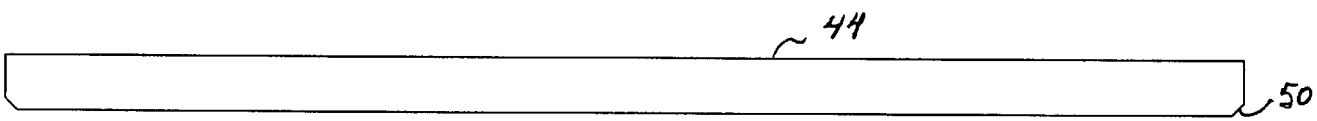
FIG. 15 is a front side view of the slab of FIG. 14.
Figure 16:
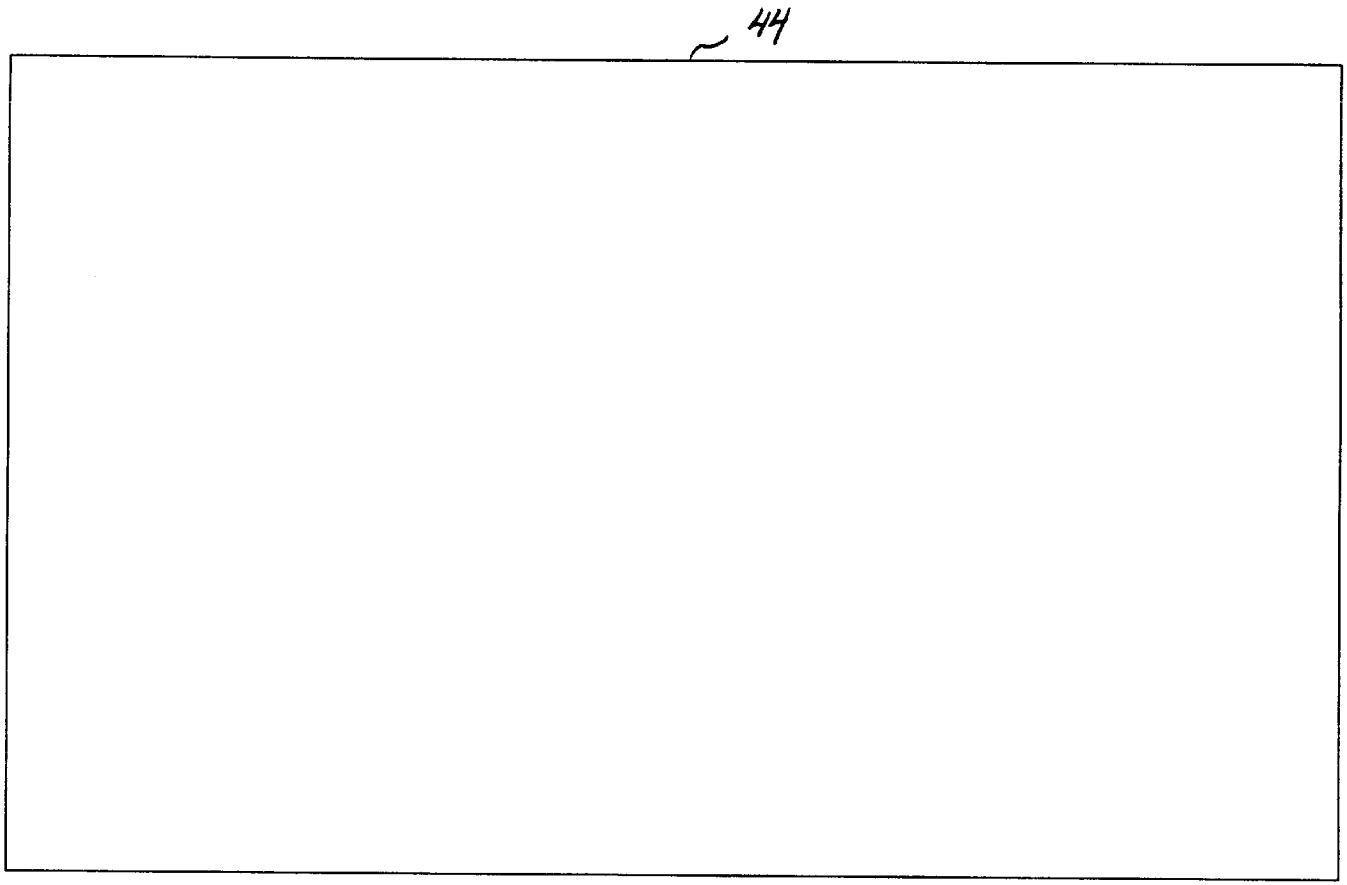
FIG. 16 is a top plan view of the slab of FIG. 14.
Figure 17:
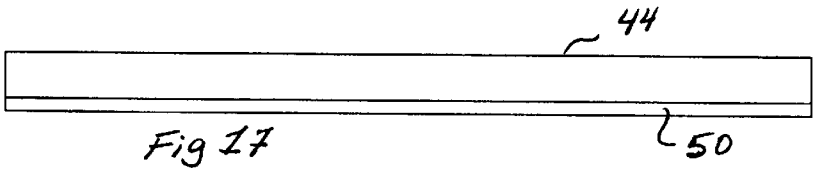
FIG. 17 is a right side elevation view of the slab of FIG. 14.

It will be appreciated that the concrete topping 55 formed on the outer support beams 22*a*, 22*b* is roughened as shown in FIG. 13 on a top surface thereof prior to a second concrete pour for forming a sidewalk 62, as is commonly done. The outer edges of the sidewalk 62 support an upwardly extending barrier wall 64 or railings for protecting motorists and pedestrians from falling off the bridge.

Those skilled in the art will appreciate that several variations may be made to the invention and that the rights associated with the invention are not limited by the details of the preceding description but are defined by the appended claims. In particular, dimensions which are provided are typical and it will clearly be understood that these may vary, as required, to suit the application and according to materials available.

What is claimed is:

1. A deck system for building a bridge superstructure, the deck system having a plurality of support beams extending longitudinally along the length of the bridge, and erected at predetermined spaced locations across the width of the bridge to define a separation, the support beams each having a plurality of beam anchors secured to the support beams;

screed adjustors provided in pairs for disposing on opposed lateral edges of the support beams;

precast concrete slabs having a width for spanning said separation between the support beams, and being disposed end to end in abutting relationship, the slabs having a plurality of slab reinforcement bars disposed within the slabs at spaced intervals along the lengths of the slabs, the slab reinforcement bars having free extremities which protrude from the slabs on opposite lateral sides thereof to lie over said support beams, and a selected number of said slab reinforcement bars additionally having portions which extend upwardly above an operatively upper surface of the slabs at regular spaced intervals to define slab anchors for securing a concrete topping to be poured onto the precast concrete slabs;

deck reinforcement bars for coupling the precast concrete slabs to the beam anchors;

and ties for securing the deck reinforcement bars to the beam anchors and to free extremities of the slab reinforcement bars.

2. A deck system according to claim 1 having a plurality of precast concrete slabs each having rectangular upper and lower faces defining a pair of long sides and a pair of short sides, the short sides being somewhat recessed to define a chamfer on forward and trailing edges extending between the support beams for the precast concrete slabs to abut one another when placed end to end and provide a flush upper surface to support a concrete topping.

3. A deck system according to claim 1 having a plurality of precast concrete slabs each having parallel lateral edges, and forward and trailing edges for abutting on adjacent precast concrete slabs, a selected number of slabs having a forward edge which is inclined relative to a respective trailing edge and a selected number of slabs having a trailing edge which is inclined relative to a respective forward edge.

4. A deck for a bridge superstructure having a plurality of support beams extending longitudinally along the length of the bridge, and erected at predetermined spaced locations across the width of the bridge to define a separation, the support beams each having a plurality of beam anchors secured to the support beams and screed adjustors disposed in pairs on opposed lateral edges of the support beams, the deck having:

a plurality of precast concrete slabs disposed end to end with forward and trailing edges abutting one another along the length of the associated support beams, the precast concrete slabs having a width for spanning said separation between the support beams, the slabs having a plurality of slab reinforcement bars disposed within the slabs at spaced intervals along the lengths of the slabs, the slab reinforcement bars having free extremities which protrude from the slabs on opposite lateral sides thereof to lie over said support beams, and a selected number of said slab reinforcement bars additionally having portions which extend upwardly above an operatively upper surface of the slabs at regular spaced intervals to define slab anchors for securing a concrete topping formed in situ on the precast concrete slabs;

deck reinforcement bars coupling the precast concrete slabs to the beam anchors;

ties securing the deck reinforcement bars to the beam anchors and to free extremities of the slab reinforcement bars; and a concrete topping formed in situ on the precast concrete slabs.

5. A deck according to claim 4 in which the precast concrete slabs have parallel lateral edges, a selected number of slabs having a forward edge which is inclined relative to a respective trailing edge and a selected number of slabs having a trailing edge which is inclined relative to a respective forward edge.

6. A deck according to claim 4 having additional reinforcement bars disposed in said concrete topping.

7. A deck according to claim 4 having a waterproof sheeting disposed above the concrete topping.

8. A deck according to claim 4 having asphalt disposed above the concrete topping.

9. A deck according to claim 7 having asphalt disposed above the waterproof sheeting.

10. A deck system according to claim 1 in which the slab anchors are defined by a plurality of inverted U-shaped portions formed by bending slab reinforcement bars into a castellated shape.

11. A deck according to claim 4 in which the slab anchors are defined by a plurality of inverted U-shaped portions formed by bending reinforcement bars into a castellated shape.

12. A deck according to claim 4 in which the precast concrete slabs each have rectangular upper and lower faces defining a pair of long sides and a pair of short sides, the short sides being somewhat recessed to define a chamfer on forward and trailing edges extending between the support beams for the precast concrete slabs to provide a flush upper surface to support the concrete topping.

13. A deck for a bridge superstructure having a plurality of support beams extending longitudinally along the length of the bridge, and erected at predetermined spaced locations across the width of the bridge to define a separation, the support beams each having a plurality of beam anchors secured to the support beams and screed adjustors disposed in pairs on opposed lateral edges of the support beams, the deck having:

a plurality of precast concrete slabs disposed end to end with forward and trailing edges abutting one another along the length of the associated support beams, the precast concrete slabs having a width for spanning said separation between the support beams, the slabs having a plurality of slab reinforcement bars disposed within the slabs at spaced intervals along the lengths of the slabs, the slab reinforcement bars having free extremities which protrude from the slabs on opposite lateral sides thereof to lie over said support beams, the precast concrete slabs each having oppositely disposed upper and lower faces and side walls coupling the upper and lower faces, the side wall adjacent to the upper face being orthogonal thereto and the side wall adjacent to the lower face on two opposite sides of the slab being somewhat recessed to define a chamfer on said forward and trailing edges extending between the support beams to provide a flush upper surface;

deck reinforcement bars coupling the precast concrete slabs to the beam anchors;

ties securing the deck reinforcement bars to the beam anchors and to free extremities of the slab reinforcement bars; and a concrete topping formed in situ on the precast concrete slabs.

14. A deck for a bridge superstructure having a plurality of support beams extending longitudinally along the length of the bridge, and erected at predetermined spaced locations across the width of the bridge to define a separation, the support beams each having a plurality of beam anchors secured to the support beams and screed adjustors disposed in pairs on opposed lateral edges of the support beams, the deck having:

a plurality of precast concrete slabs disposed end to end with forward and trailing edges abutting one another along the length of the associated support beams, the precast concrete slabs having a width for spanning said separation between the support beams, the slabs having a plurality of slab reinforcement bars disposed within the slabs at spaced intervals along the lengths of the slabs, the slab reinforcement bars having free extremities which protrude from the slabs on opposite lateral sides thereof to lie over said support beams, and a selected number of said slab reinforcement bars additionally having portions which extend upwardly above an operatively upper surface of the slabs at regular spaced intervals to define slab anchors for securing a concrete topping formed in situ on the precast concrete slabs;

the precast concrete slabs each having oppositely disposed upper and lower faces and side walls coupling the upper and lower faces, the side wall adjacent to the upper face being orthogonal thereto and the side wall adjacent to the lower face on two opposite sides of the slab being somewhat recessed to define a chamfer on said forward and trailing edges extending between the support beams to provide a flush upper surface;

deck reinforcement bars coupling the precast concrete slabs to the beam anchors;

ties securing the deck reinforcement bars to the beam anchors and to free extremities of the slab reinforcement bars; and a concrete topping formed in situ on the precast concrete slabs.

* * * * *